US011058191B2

(12) United States Patent
Martin et al.

(10) Patent No.: US 11,058,191 B2
(45) Date of Patent: Jul. 13, 2021

(54) BRACELET FASTENING SYSTEM

(71) Applicant: The Swatch Group Research and Development Ltd, Marin (CH)

(72) Inventors: Jean-Claude Martin, Montmollin (CH); Cedric Nicolas, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/364,900

(22) Filed: Mar. 26, 2019

(65) Prior Publication Data

US 2019/0365061 A1 Dec. 5, 2019

(30) Foreign Application Priority Data

Jun. 4, 2018 (EP) ..... 18175782

(51) Int. Cl.
*A44C 5/20* (2006.01)
*A44C 5/00* (2006.01)

(52) U.S. Cl.
CPC ..... *A44C 5/2057* (2013.01); *A44C 5/0053* (2013.01)

(58) Field of Classification Search
CPC ..... A44C 5/2076; A44C 5/2071; A44C 5/18; A44C 5/20; A44C 5/0069; A44C 5/04; A44B 11/25; A44B 11/2592; Y10T 24/4782; Y10T 403/32581
USPC ..... 63/3.1, 3.2; 24/265 R, 265 WS, 265 A, 24/265 EE; 224/165, 175
See application file for complete search history.

(56) References Cited

U.S. PATENT DOCUMENTS 3,518,727 A * 7/1970 Eberle ..... F16L 3/233 24/16 PB
3,631,573 A * 1/1972 King ..... A44C 5/105 24/265 WS
3,706,404 A * 12/1972 Campbell ..... A44C 5/0069 224/175

(Continued)

FOREIGN PATENT DOCUMENTS

CH 402485 A * 11/1965 ..... A44C 5/0069
CH 711 587 A1 3/2017

(Continued)

OTHER PUBLICATIONS

European Search Report dated Sep. 28, 2018 in European Application 18175782.4 filed on Jun. 4, 2018 (with English translation of categories of Cited Documents).

(Continued)

*Primary Examiner* — Emily M Morgan
(74) *Attorney, Agent, or Firm* — Oblon, McClelland, Maier & Neustadt, L.L.P.

(57) ABSTRACT

A bracelet including two strands provided with a fastening system which includes at least one longitudinal groove on one of the two strands and at least one longitudinal protuberance on the other strand. The material and the shape of the groove and of the protuberance are configured such that these two elements interlock under pressure exerted by the bracelet user, over two overlapping portions of the bracelet strands. The connection between the strands can easily be separated, preferably by peeling the upper strand away from the lower strand. The bracelet is continuously adjustable in length, without requiring heavy or complex elements.

13 Claims, 3 Drawing Sheets

(56) References Cited

U.S. PATENT DOCUMENTS

| | | | | |
|---|---|---|---|---|
| 3,930,287 | A * | 1/1976 | Grise | A44C 5/0053 24/16 PB |
| 4,513,896 | A * | 4/1985 | Hirsch | A44C 5/0053 224/178 |
| 6,880,364 | B1 * | 4/2005 | Vidolin | A44C 5/025 40/633 |
| 2008/0301853 | A1 | 12/2008 | Cummiskey et al. | |
| 2009/0038339 | A1 * | 2/2009 | Chen | A44C 9/0015 63/15 |
| 2011/0209374 | A1 | 9/2011 | Padgett et al. | |
| 2012/0214380 | A1 * | 8/2012 | Vine, III | A44C 5/0084 446/121 |
| 2015/0089975 | A1 * | 4/2015 | Paleschuck | G09F 23/00 63/1.13 |
| 2016/0037878 | A1 * | 2/2016 | Yabe | G04B 37/1486 24/3.1 |
| 2017/0188669 | A1 * | 7/2017 | Dukerschein | A44C 5/2071 |
| 2018/0271232 | A1 | 9/2018 | Yabe et al. | |
| 2018/0289117 | A1 * | 10/2018 | Guirguis | A44C 9/00 |
| 2019/0298007 | A1 * | 10/2019 | Velger | A42B 1/225 |

FOREIGN PATENT DOCUMENTS

| | | | | |
|---|---|---|---|---|
| CN | 203913673 | U | 11/2014 | |
| DE | 85 06 454 | U1 | 7/1986 | |
| DE | 10121379 | A1 * | 11/2002 | F16B 2/08 |
| GB | 130864 | A * | 8/1919 | A44C 5/2071 |
| JP | S52-148962 | | 5/1976 | |
| JP | S55-127512 | | 3/1979 | |
| JP | S54-77780 | | 6/1979 | |
| JP | H10-245067 | A | 9/1998 | |
| JP | 2005-171013 | A | 6/2005 | |
| KR | 10-1462450 | B1 | 11/2014 | |

OTHER PUBLICATIONS

Notice of the Reason for Refusal dated Jun. 9, 2020 in corresponding Japanese Patent Application No. 2019-046748 (with English translation)(9 pages).

Notice of the Reason for Refusal dated Feb. 16, 2021 in corresponding Japanese Patent Application No. 2019-046748 (with English translation)(9 pages).

* cited by examiner

BRACELET FASTENING SYSTEM

CROSS-REFERENCE TO RELATED APPLICATION

This application claims priority to European Patent Application No. 18175782.4 filed on Jun. 4, 2018, the entire disclosure of which is hereby incorporated herein by reference.

FIELD OF THE INVENTION

The present invention relates to bracelet fastening systems, particularly for flexible bracelets made of synthetic material such as for watch straps or jewellery bracelets.

STATE OF THE ART

Watch straps or bracelets provided with a buckle or a deployant clasp have been known for a long time. These systems are quite susceptible to wear, especially those made of synthetic materials, relatively thick and thus uncomfortable, and have the additional drawback that the bracelet length is adjusted in a non-continuous manner, i.e. in discrete positions, which means that the length thereof cannot be properly adjusted to the diameter of the wearer's wrist. Alternatives have been proposed, such as bracelets with magnetic or clip fastenings, which allow for more flexible adjustment, but which are often heavy and difficult to use, and/or require a complex and expensive manufacturing method. Further, buckles and deployant clasps are of considerable thickness which may, in some cases, be greater than that of the watch to which they are fitted, thereby marring the aesthetic appearance and possibly the comfort of the wristwatch.

SUMMARY OF THE INVENTION

It is an object of the present invention to provide a bracelet fitted with a light, slim, compact, continuously adjustable fastening system, which is both easy to use and manufacture. This object is achieved by a bracelet according to the attached claims.

The invention concerns a bracelet comprising two bracelet strands and provided with a fastening system which includes at least one longitudinal groove on one of the two strands and at least one longitudinal protuberance on the other strand. The material and the shape of the groove and of the protuberance are configured such that these two elements interlock under pressure exerted by the bracelet user, over two overlapping portions of the bracelet strands. The connection between the bracelet strands can easily be separated, preferably by peeling the upper strand away from the lower strand, but without opening. The bracelet of the invention is continuously adjustable in length, without requiring heavy or complex elements.

Other features and advantages of the present invention will appear in the following description of preferred embodiments, given by way of non-limiting example, with reference to the annexed drawings.

DETAILED DESCRIPTION OF SEVERAL EMBODIMENTS OF THE INVENTION

Figure 1:
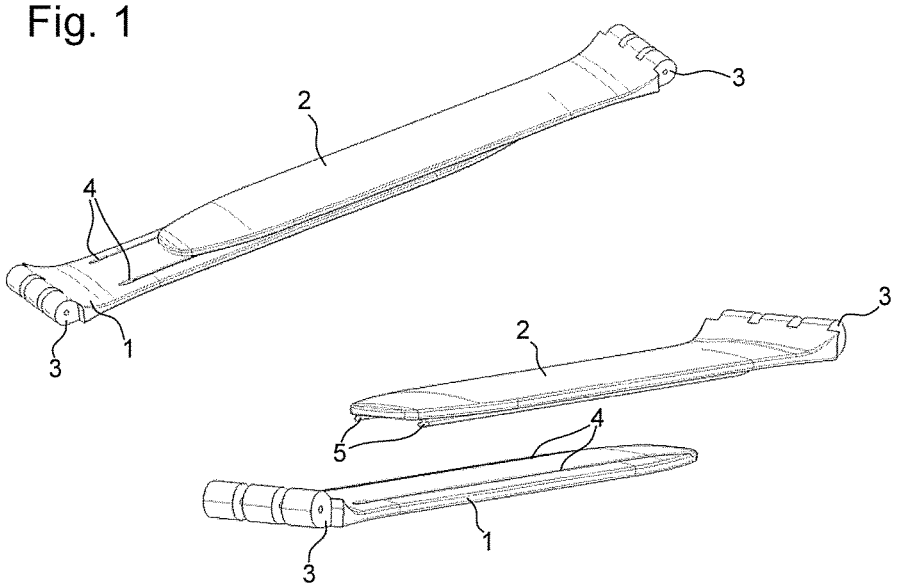
FIG. 1 represents a bracelet according to a preferred embodiment of the invention.
Figure 6:
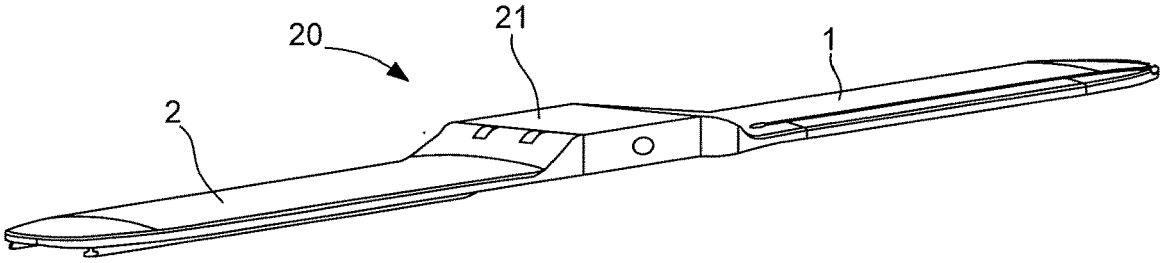
FIG. 6 represents a watch provided with the bracelet fitted with the fastening system according to the invention.

FIG. 1 represents the two strands 1 and 2 of a watch bracelet according to a non-limiting embodiment of the invention and FIG. 6 represents a watch 20 fitted with this bracelet. The strands are substantially flat and flexible, and provided with two attachments 3 for securing a watch case 21 (FIG. 6). To fasten the bracelet, the user covers one strand, referred to as the 'lower strand' 1, with a portion of the other strand, referred to as the 'upper strand' 2. Lower strand 1 has two grooves 4, which are parallel relative to each other and extend over essentially the entire length of its interaction surface with upper strand 2. Said upper strand 2 includes two protuberances 5 extending essentially over the entire length of its interaction surface with lower strand 1 and preferably in a continuous manner, thereby forming two substantially parallel rail portions. Protuberances 5 are positioned and formed such that they fit into the respective grooves 4, when the user exerts pressure on the overlapping portions of the strands to secure the lower and upper strands to each other.

Figure 2:
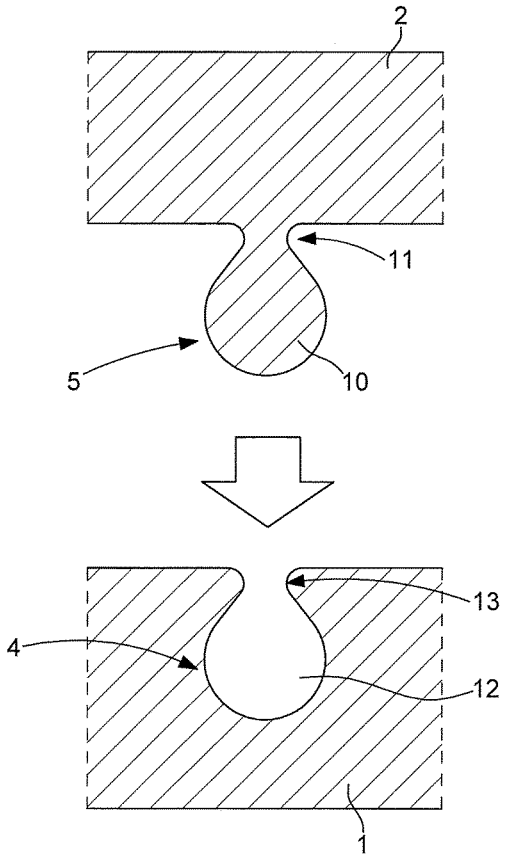
FIG. 2 represents a sectional view of cooperating elements in the bracelet of FIG. 1.

The cross-section of a protuberance 5 and of the corresponding groove 4 is represented in detail in FIG. 2, for the case where strands 1 and 2 are uniform elements, i.e. formed of a single material. It is seen that the cross-section of protuberance 5 of upper strand 2 includes a portion 10 of circular shape, referred to as the 'male housing portion', which is attached to strand 2 by a neck section 11, which is narrower than housing portion 10. The cross-section of groove 4 of lower strand 1 also includes a housing portion 12 of circular shape, referred to as the 'female housing portion', which is accessible via a neck section 13. Neck sections 11 and 13 are thus located between male and female housing sections 10 and 12 and the interaction surface of the respective strand 2 and 1. The dimensions of elements 12 and 13 of groove 4 are equal to or slightly greater than the dimensions of the corresponding elements of protuberance 5.

It is evident that, in a variant, the male and female housing portions can have cross-sections of different shape, provided there is a protuberance with a neck section and a groove with a neck section.

It will be noted that, although in the illustrated example, the protuberances and grooves are rectilinear, it is also possible to envisage protuberances and corresponding grooves that extend in curved or wavy lines.

The material of at least one of strands 1 and 2 is sufficiently flexible for protuberances 5 to interlock in a snap fit manner with grooves 4 when the user compresses the overlapping strand portions. Under the pressure exerted by the user, protuberances 5 and/or grooves 4 undergo a slight elastic deformation which allows male housing portions 10 of protuberances 5 to pass through neck sections 13 of grooves 4, resulting in a connection that is fixed in the perpendicular direction relative to strands 1 and 2, but which can easily be separated, preferably by peeling upper strand 2 away from lower strand 1. 'Peeling' means a manipulation by the user which consists in pulling back upper strand 2 by taking the end of upper strand 2 and gradually separating it from lower strand 1. This manipulation allows protuberance (s) 5 to be removed from their groove 4 to unlock the fastening system. The number, position and size of the grooves can be adjusted according to the desired design, material and hold.

Figure 3:
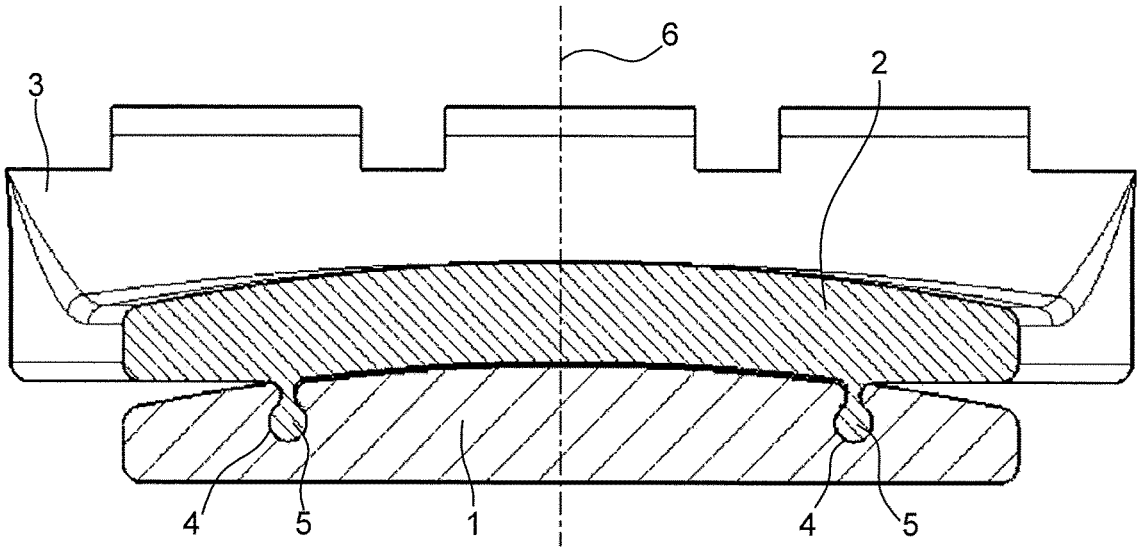
FIG. 3 represents a sectional view of the complete bracelet of FIG. 1.

FIG. 3 represents the cross-section of the entire bracelet of FIG. 1, in the fastened position. It is seen that the two protuberances 5 are housed inside the corresponding grooves 4. Protuberances 5 and grooves 4 are on both sides and are symmetrical with respect to the central longitudinal plane 6 of the assembled strands. The friction forces between strands 1 and 2 will prevent separation by sliding. Preferably, the cross-section of the interaction surface of lower strand 1 is slightly convex curved so that upper strand 2 follows the curve of said surface in the fastened position. Upper strand 2 is thus pressed against lower strand 1 by the retention forces between the interlocked grooves 4 and protuberances 5, which will increase the friction forces between strands 1 and 2.

Figure 4:
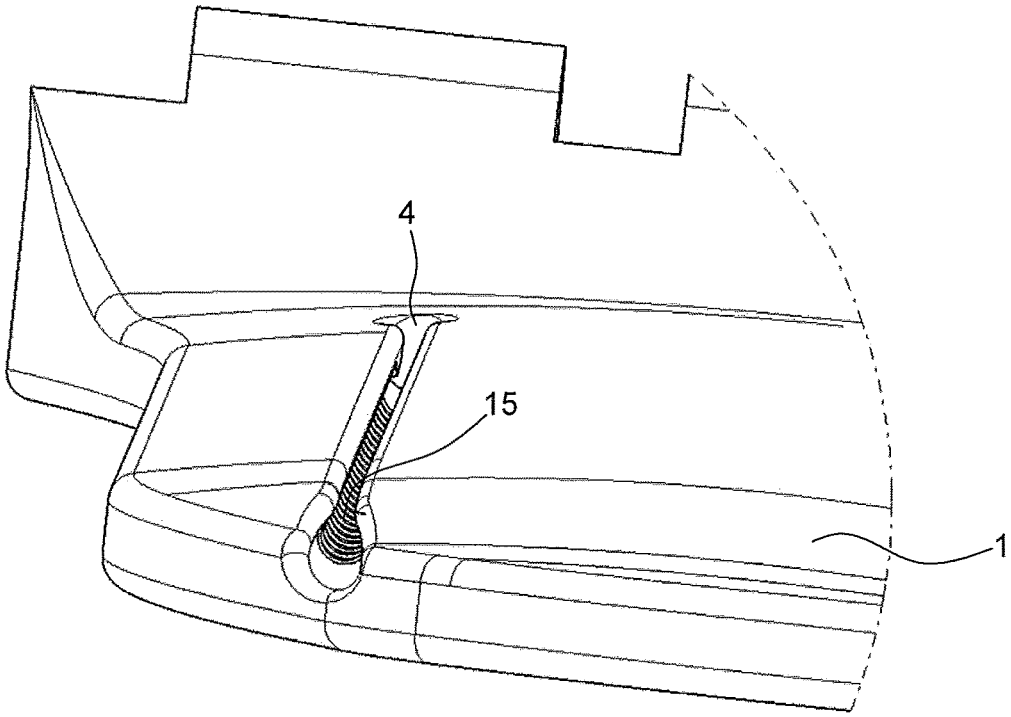
FIG. 4 represents an embodiment of a bracelet strand provided, in its groove, with means for increasing the friction forces between the bracelet strands.

In the embodiment illustrated in FIG. 4, grooves 4 of lower strand 1 are provided with an area 15 whose surface has been structured which increases the roughness of said surface. This structure will increase the friction forces between groove 4 and the protuberance 5 housed therein. The structured surface may be arranged on grooves 4, on protuberances 5 or on both. By way of example, the structure may be formed of a series of bulges forming waves extending along the longitudinal direction of the groove. The structure may be arranged continuously over the entire length of the protuberances and/or grooves or at regular intervals.

Instead of a structured surface, and according to variants, other anti-friction means may be created on grooves 4 and/or on protuberances 5, such as changes to the dimensions, for example waves or bulges at regular intervals.

Figure 5:
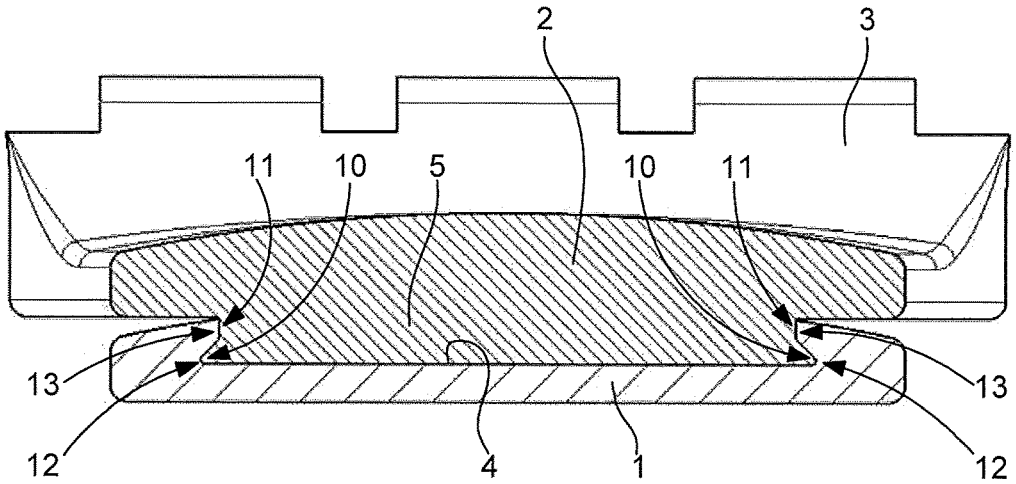
FIG. 5 is a sectional view of a bracelet according to another embodiment of the invention.

The number of protuberances 5 and the number of corresponding grooves 4 arranged on bracelet strands 1 and 2 is not limited within the context of the invention. FIG. 5 represents a sectional view of a bracelet whose lower strand 1 has only one groove 4, whose width is close to the width of strand 1. A single protuberance 5 is arranged on upper strand 2. Protuberance 5 and groove 4 again include a neck section 11, 13 and a housing portion 10, 12, which allow the bracelet to be fastened in an elastic snap fit, owing to a degree of flexibility of at least one of the materials used.

According to embodiments of the invention, each strand is a uniform element made of plastic material which makes it possible to manufacture the strands by casting, injection moulding or extrusion, or by thermocompression. Various injectable polymers or vulcanized rubber can be used. Alternatively, a combination of different materials can be envisaged, for example, a bi-material injection process to form areas of different rigidity can be envisaged. For example, it is possible to use rigid, semi-rigid or articulated strands, for example with metal or ceramic or leather links. One of the strands then includes one or more grooves machined into the links. The other strand is provided with one or more protuberances made of flexible material, such as rubber, which is attached (for example bonded or overmoulded) to the bracelet link surface.

It is evident that the position of grooves 4 and of protuberances 5 can be reversed relative to the positions shown in the Figures: protuberances 5 can be on lower strand 1 and grooves 4 can be on upper strand 2.

Preferably, there is only one protuberance 5 for each groove 4. Alternatively, a number of longitudinal protuberances 5 arranged in series could be provided for each groove, all of which interlock in the same groove 4.

Figure 7:
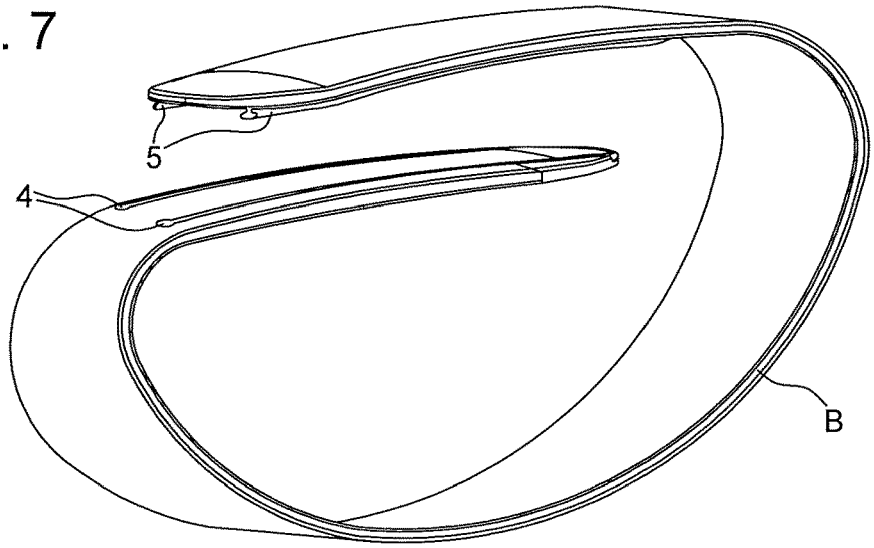
FIG. 7 represents a bracelet according to another embodiment of the invention wherein the two strands are in one piece and form a band.

The bracelet of the invention is not limited to a watch strap including a watch case and two separate strands. The invention also includes a bracelet wherein the first and second strands are connected to each other by one of their ends to form a band B in one piece of material, for example known as a 'NATO' strap, and wherein portions at both ends of the band overlap when the user puts on the bracelet, as illustrated in FIG. 7, in which those elements described with reference to FIGS. 1 to 6 refer to the same elements. A bracelet of this type and according to the invention includes a first portion on one side of the band, provided with at least one groove 4 and a second portion on the other side of the band provided with at least one protuberance 5, as described above. The two portions of band B represent in this case the 'first and second strand' in a bracelet according to the invention.

A bracelet according to the invention combines continuous length adjustment with a number of additional advantages. The bracelet is easy to use and to manufacture. It is light since there is no added weight for the clasp or magnets. It is comfortable for the user owing to the absence of rigid elements and to its compact size. Further, it is very simple to maintain and avoids accumulation of dirt, as is the case with deployant clasps.

It will also be noted that the insertion and peeling force can easily be changed by adapting the geometry, position and/or number of protuberance/groove pairs.

The invention claimed is:

1. A bracelet comprising:

a first strand and a second strand and wherein one surface of one of the strands at least partially covers one surface of the other strand when the bracelet is fastened, wherein:

the bracelet further comprises a fastening system including only at least one groove which extends over said first strand surface in the longitudinal direction of said first strand, and at least one protuberance which extends over said second strand surface in the longitudinal direction of said second strand, and wherein the protuberance and the groove comprise a housing portion and a neck section with said neck section located between the housing portion and the respective strand surface, the material of at least one of the protuberance and the groove has a degree of flexibility which allows the housing portion of the protuberance to interlock with the housing portion of the groove such that one of said first or second strands is in a lower position and the other of said first or second strands is in an upper position, and the bracelet does not include a clasp or a magnet, wherein the first strand comprises two grooves and the second strand comprises two protuberances, the two grooves and the two protuberances being arranged on both sides and in a symmetrical manner with respect to the central longitudinal plane of the respective strands, wherein the cross-section of an upper surface of the first strand is curved convex and the second strand and the two grooves and the two protuberances are positioned such that, when the two protuberances are positioned in the two grooves, a lower surface of the second strand is concave between the two protuberances to follow a curvature of the upper surface of the first strand, and wherein, when the two protuberances are positioned in the two grooves, the lower surface of the second strand laterally outside of the two protuberances is substantially planar.

2. The bracelet according to claim 1, configured such that, in the fastened position of the bracelet, peeling the second strand away from the first strand allows the protuberance to be removed from the groove to unlock the bracelet fastening system.

3. The bracelet according to claim 1, wherein the strands are uniform elements formed of a flexible material.

4. The bracelet according to claim 3, wherein the strands are formed of polymer or rubber.

5. The bracelet according to claim 1, wherein at least one of said groove and said protuberance is an element formed of flexible material, and wherein said flexible material is a different material from the material of the strand to which the at least one of the groove and the protuberance formed of flexible material is attached.

6. The bracelet according to claim 1, wherein at least one of the groove and the protuberance is provided with one or more areas whose surface is provided with a structure that increases the roughness of said surface.

7. The bracelet according to claim 1, wherein the surface of at least one of the groove and the protuberance is provided with dimensional changes in said surface, at regular intervals.

8. The bracelet according to claim 1, wherein the housing portions of the protuberance and of the corresponding groove have a cross-section of circular shape.

9. The bracelet according to claim 1, wherein the first and second strands are connected to each other by one of the ends thereof to form a one-piece band.

10. The bracelet according to claim 9, wherein the first and second strands are made in one piece.

11. The bracelet according to claim 1, wherein the bracelet is a watch or jewellery bracelet.

12. The bracelet according to claim 1, wherein a length of the groove of said first strand surface is equal to a length of the protuberance of said second strand surface.

13. The bracelet according to claim 1, wherein each of the two grooves includes a plurality waves at regular intervals along a longitudinal direction of each of the two grooves.

* * * * *